US005535718A

United States Patent [19]

Nakai et al.

[11] Patent Number: 5,535,718

[45] Date of Patent: Jul. 16, 1996

[54] THROTTLE LINKAGE SYSTEM

[75] Inventors: Hiroshi Nakai; Akihiko Hoshiba; Sadato Yoshida; Yasuhiko Shibata, all of Hamamatsu, Japan

[73] Assignee: Sanshin Kogyo Kabushuki Kaisha, Hamamatsu, Japan

[21] Appl. No.: 302,208

[22] Filed: Sep. 8, 1994

[30] Foreign Application Priority Data

Sep. 8, 1993 [JP] Japan ..... 5-247584

[51] Int. Cl.[6] ..... F02D 9/08

[52] U.S. Cl. ..... 123/336; 137/595; 251/228

[58] Field of Search ..... 123/336, 583; 74/108, 581; 137/595, 601; 251/228, 279, 305

[56] References Cited

U.S. PATENT DOCUMENTS

| | | | |
|---|---|---|---|
| 2,085,818 | 7/1937 | Messinger et al. | 123/583 X |
| 2,420,925 | 5/1947 | Wirth | 123/583 |
| 2,761,437 | 9/1956 | Stolte | 123/184.39 |
| 4,016,838 | 4/1977 | Yoshioka et al. | 123/583 |
| 4,566,424 | 1/1986 | Billingsley et al. | 123/583 |
| 4,632,082 | 12/1986 | Hattori et al. | 123/325 |
| 4,823,748 | 4/1989 | Ampferer et al. | 123/336 |

FOREIGN PATENT DOCUMENTS

| | | | |
|---|---|---|---|
| 60-150444 | 8/1985 | Japan | 123/583 |

*Primary Examiner*—Tony M. Argenbright
*Attorney, Agent, or Firm*—Knobbe, Martens, Olson & Bear

[57] ABSTRACT

A throttle linkage system for synchronizing the movement between a plurality of throttle valves journaled in throttle bodies affixed to a common member that includes a link that has the same coefficient of thermal expansion as the member to which the throttle bodies are connected so as to avoid synchronization problems due to different thermal expansions. In addition, the linkage system is such that it accommodates manufacturing variations from the more remotely positioned throttle valves by providing a structure for permitting relative movement.

13 Claims, 4 Drawing Sheets

THROTTLE LINKAGE SYSTEM

BACKGROUND OF THE INVENTION

This invention relates to a throttle linkage system and more particularly to an improved linkage system for synchronizing the movement between a plurality of throttle valves.

In many applications of internal combustion engines having a plurality of induction passages each induction passage is served by a respective throttle body in which a throttle valve is positioned. For example, it is typical with multi-cylinder engines to employ plural carburetors all affixed to a common manifold and which have individual throttle valves. Obviously, it is desirable to have all of the throttle valves operated in unison and it has been practiced to provide a throttle actuator which is connected to the throttle valve of one of the throttle bodies and that throttle valve is connected to the remaining throttle valves through a linkage system. However, there are some disadvantages with the types of systems previously proposed.

Frequently, the throttle bodies are affixed to an intake manifold or other portion of the engine which is formed from a lightweight material such as aluminum or an aluminum alloy. However, the throttle linkage for the synchronization of the throttle valves may use interconnecting links or a single link formed from a more corrosion-resistant material such as stainless steel. As a result of this arrangement, the different thermal expansion between the throttle bodies and the linkage system can cause discrepancies in the positions of the throttle valves which are not desirable.

In addition to these disadvantages, the inherent structure is such that the alignment of the individual throttle bodies and interconnecting member may not be completely accurate. In addition, the throttle valves are interconnected by a system of levers that are affixed to the throttle valve shafts and which contain at their outer extremities pins that are received in bores in the interconnecting linkage. However, due to manufacturing variations the pin and bore relationship may not be exact. Such misalignments can cause binding in not only the throttle linkage but also in the throttle valve shaft itself that presents obvious difficulties.

It is, therefore, a principal object of this invention to provide an improved throttle linkage system for synchronizing a plurality of throttle valves.

It is a further object of this invention to provide a throttle linkage system for synchronizing a plurality of throttle valves for an engine and wherein the synchronization can be maintained without concern for different thermal expansions.

It is a further object of this invention to provide an improved and simplified throttle linkage system for an engine wherein misalignment can be tolerated without upsetting the synchronization of the individual throttle valves.

SUMMARY OF THE INVENTION

This invention is adapted to be embodied in a throttle linkage system for an engine having a plurality of throttle bodies that are affixed to a common member for supplying a controlled charged to respective chambers of the engine. Each throttle body includes a portion that defines an induction passage, a throttle valve shaft rotatably journaled in the body, a throttle valve affixed to the throttle valve shaft and positioned within the induction passage and a throttle lever affixed to the respective throttle valve shaft for operating the throttle valve associated with it. A throttle linkage is pivotally connected to the throttle valve levers for synchronizing their movement.

In accordance with a first feature of the invention, the throttle linkage is formed from a material having the same or a similar coefficient of thermal expansion as the common member to which the throttle bodies are affixed.

In accordance with another feature of the invention, a manual actuator is operably connected to one of the throttle levers and the remaining throttle levers are operated from this one throttle lever through the throttle link. The connection between the throttle link and the throttle levers of the throttle body is positioned more remotely from the manually operated throttle lever accommodates relative movement to compensate for manufacturing variations.

DETAILED DESCRIPTION OF THE PREFERRED EMBODIMENTS OF THE INVENTION

Figure 1:
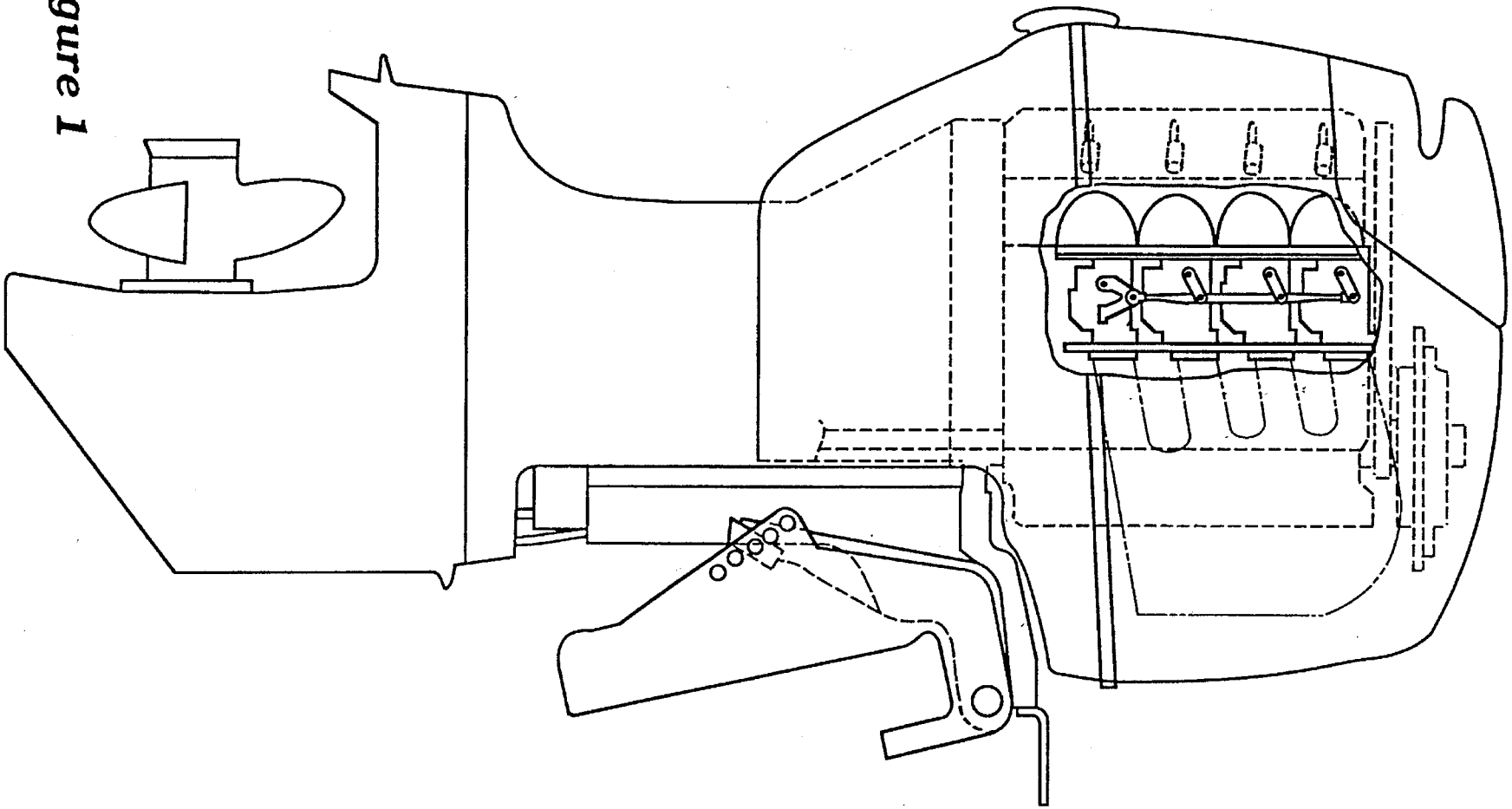
FIG. 1 is a side elevational view of an outboard motor constructed in accordance with an embodiment of the invention.

Referring now in detail to the drawings and initially to FIG. 1, an outboard motor embodying this invention is identified generally by the reference numeral 11. The invention is described in conjunction with an outboard motor as an example of a type of construction where it has particular utility. This is because outboard motors frequently employ induction systems that include plural throttle bodies all affixed to a common member and having a throttle linkage system that is interconnected for throttle synchronization. This is, as noted above, the area of the invention. It will be readily apparent to those skilled in the art, however, that the invention may be employed in a wide variety of other types of environments than outboard motors.

The outboard motor 11 includes a power head, indicated generally by the reference numeral 12 which is comprised of an internal combustion engine 13 and a protective cowling comprised of a lower tray member 14 and a main cover member 15 which are connected to each other by means of a releasable latch 16 in a well known manner. In the illustrated embodiment, the engine 13 is of the four cylinder in-line type and operates on a four cycle principle. It will be readily apparent to those skilled in the art, however, how the invention may be employed in conjunction with other types of engines having other cylinder numbers and other cylinder configurations as well as engines operating on other than the four-stroke principle. In fact, the invention has utility in conjunction with rotary as well as reciprocating engines, as will be readily apparent to those skilled in the art.

As is typical with outboard motor practice, the engine 13 is mounted on a spacer plate 17 so that its crankshaft 18 rotates about a vertically extending axis. This crankshaft is driving coupled to a drive shaft 19 that is positioned within a drive shaft housing 21. The drive shaft housing 21 depends from the power head 12 and the spacer plate 17 is positioned at its upper end. The drive shaft 19 depends into a lower unit 22 and drives a propeller 23 through a conventional forward, neutral reverse transmission.

A steering shaft (not shown) is affixed in a known manner to the drive shaft housing 21 and is journaled for steering movement about a generally vertically extending steering axis within a swivel bracket 24. A tiller 25 is affixed to the upper end of this steering shaft for steering of the outboard motor 11 in a well known manner. The swivel bracket 24 is pivotally connected by means of a pivot pin 26 to a clamping bracket 27. This pivotal connection affords tilt and trim movement of the outboard motor 11 as is also well known in this art. The clamping bracket 27 contains a suitable mechanism for attachment of the outboard motor 11 to the transom of an associated watercraft (not shown).

It is to be understood that the foregoing description of the outboard motor 11 is primarily for orientation purposes as noted above.

Figure 2:
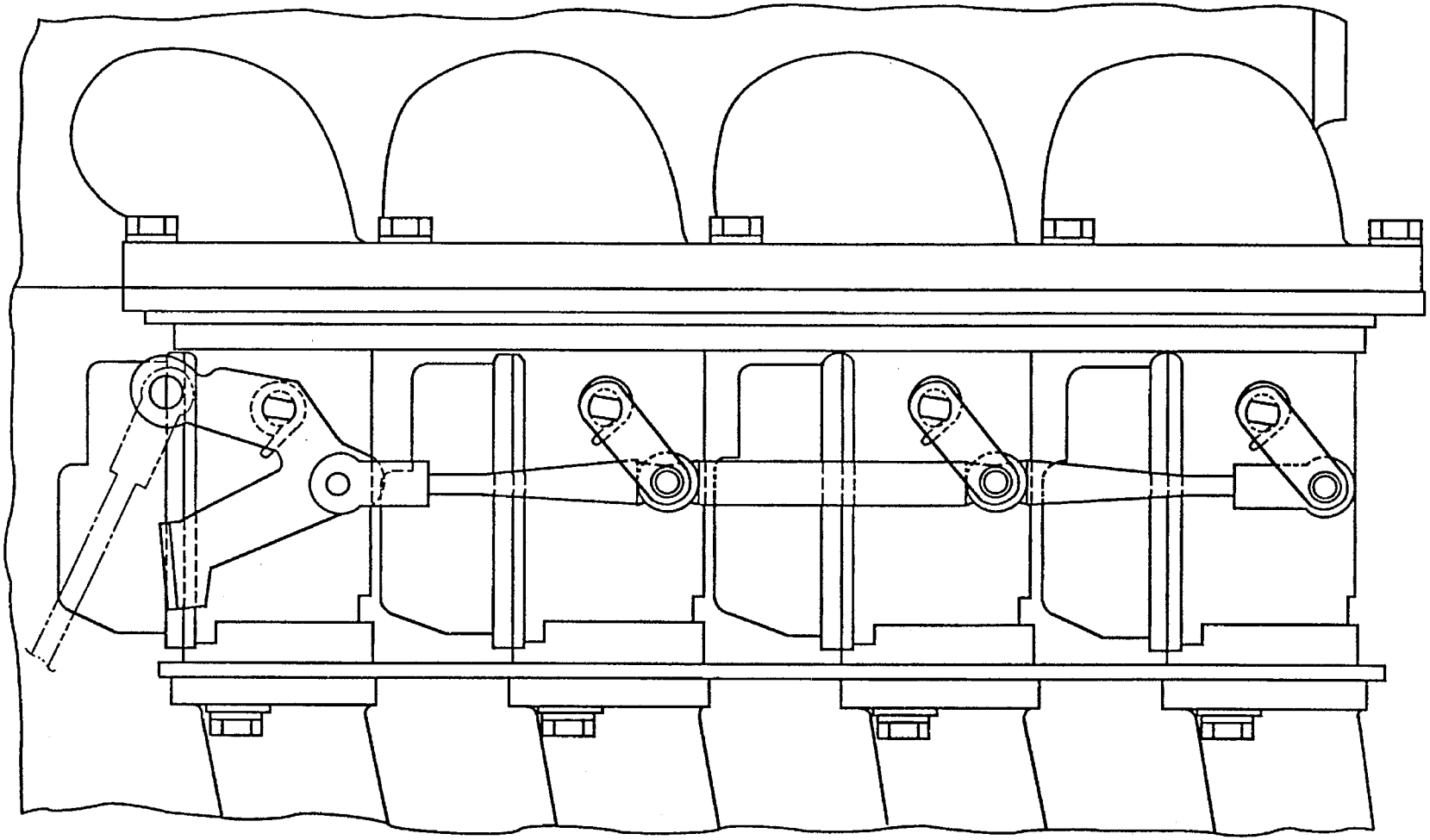
FIG. 2 is an enlarged side elevational view of the outboard motor and shows the throttle linkage system.

Referring now to FIG. 2 in addition to FIG. 1, the engine 13 includes a cylinder block 28 in which the cylinder bores are formed. Since the internal construction of the engine 13 may be conventional and it is not necessary to understand the construction and operation of the invention, a further description of it except as necessary to understand the construction and operation of the inventive features will not be made.

However, the engine 13 includes a cylinder head 29 that is affixed to the cylinder block 28 in a well known manner and which contains an induction and exhaust system for the engine including an integral induction manifold that includes runner portions 31 which define induction passages that extend through the cylinder head 29 and terminate at the individual combustion chambers of the engine 13. Since the engine 13 is described as having four cylinders, there are four manifold runners 31. These manifold runners 31 terminate at a flange 32 to which an induction system is attached. As is typical with engine practice, the cylinder head 29 and particularly its manifold runners 31 and mounting flange 32 may be formed from a lightweight metal such as aluminum or aluminum alloy and which has a relatively high coefficient of thermal expansion.

The induction system for supplying the manifold runners 31 includes an air inlet device, shown in phantom in FIG. 1 and identified generally by the reference numeral 33 which has a downwardly facing air inlet opening that receives air from within the protective cowling 15. This air is admitted through an air inlet opening 34 formed at the rear of the main cowling member 15. The air inlet device 33 is designed also so as to silence the intake air and is disposed to one side of a crankcase member 35 which is affixed to the cylinder block 28 in a known manner and in which the crankshaft 18 is rotatably journaled.

The air inlet device serves a plurality of air pipes 36 which as shown in FIG. 2 have flange portions 37 that are affixed to throttle bodies, indicated generally by the reference numeral 38 by fasteners 40. In this specific embodiment of the invention, the throttle bodies 38 actually comprise carburetors for forming a fuel air mixture and supplying it to the manifold runners 31. It is to be understood, however, that the invention may be employed in conjunction with fuel injected engines where pure throttle bodies are employed rather than the carburetors 38. An interconnecting flange 39 is disposed between the carburetors 38 and the air inlet flanges 37 so as to provide a unitary assembly.

Each carburetor 38 defines an induction passage 41 (only one of which is shown in broken lines in FIG. 2). A throttle valve shaft 42 is journaled for rotation in the carburetor body and extends transversely across the respective induction passage 41. A throttle valve of the butterfly type 43 is affixed to the throttle valve shaft 42 and cooperates with the induction passage 41 to control the air flow therethrough and, accordingly, the speed of the engine. Although the throttle valve shafts 42 associated with each of the carburetors 38 are identified by the same reference numeral, the suffixes a, b, c, and d have been applied to those associated with the carburetor progressing from the bottom to the top so as to facilitate description.

The carburetors 38 are affixed to the manifold flange 32 by an interconnecting assembly that is comprised of a first plate 44 that is relatively rigid and is affixed to the carburetors 39, a second plate 45 that is relatively rigid and which is affixed to the manifold flange 32 by threaded fasteners 46 and an intermediate interconnecting elastic bushing 47 so as to afford some relative movement to compensate for thermal expansion. However, although some such relative movement is permitted, nevertheless the construction is such that the carburetors 38 will be subject to some movement upon thermal expansion of the cylinder head 29 and specifically its manifold runners 31.

The throttle valve shaft **42*a* associated with the lowermost carburetor 38 is operated from a remote location by a bowden wire throttle control shown in phantom and indicated by the reference numeral 48. This throttle control has a connection by means of a pivot pin 49 to a manually operated throttle lever 51 that is affixed for rotation with the throttle valve shaft 42. It should be noted that there is a torsional spring 52 associated with each of the throttle valve shafts 42** for urging the respective throttle valves toward their idle position with this position being adjusted by an adjusting screw (not shown).

Figure 3:
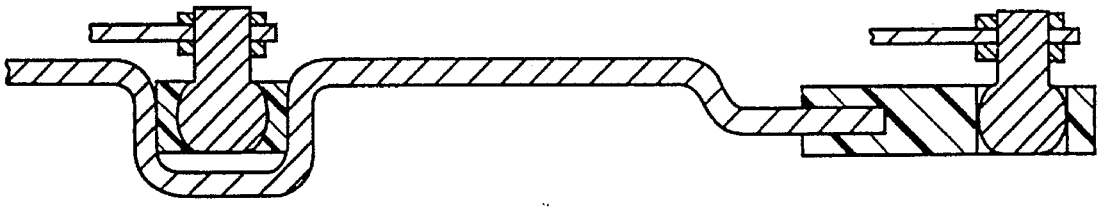
FIG. 3 is an enlarged cross-sectional view taken along the line 3—3 of FIG. 2 and shows the interconnection between the throttle link and the remotely positioned throttle lever.

Throttle control levers **53*b*, 53*c*, and 53*d* are connected to the remaining throttle shafts 42*b*, 42*c*, 42*d*, respectively. In order to transmit motion from the manually operated throttle valve shaft 42*a* to the remaining throttle valve shafts 42*b*, 42*c*, 42*d*, an interconnecting linkage arrangement, indicated generally by the reference numeral 54 is provided which interconnecting linkage ensures synchronous movement of all of the throttle valve shafts 42 as well as resisting loss of synchronization due to thermal expansion and to avoid binding due to manufacturing variance. A first embodiment of such a linkage is shown in most detail in FIG. 3 and will now be described by reference to that figure along with FIGS. 1 and 2**.

The interconnecting throttle linkage 54 includes an elongated link 55 that has a pivotal connection, as will be described, to each of the throttle levers 51 and **52*b–d*. The throttle link 55 is constructed from a material which has substantially the same coefficient of thermal expansion as that of the cylinder head 13 and specifically the flange 32 to which the carburetors 38** are affixed. This may be done by either forming it from the same material, i.e., aluminum or aluminum alloy or some other material which has substantially the same thermal expansion.

The lower end of the link 55 is connected to the manually operated throttle lever by a connector 56 which has a pivotal connection at 57 to the manual throttle lever 51. This connection may be the same as that between the upper throttle control lever 53*d* and the upper end of the link 55 and which connector is also identified by the reference numeral 56 in FIG. 3. This connecting member 56 may be formed from any material and preferably may be formed from a molded plastic or the like so as to provide a anti-friction connection.

As may be seen, each of the throttle levers 51 and 53*b–d* has affixed to it a connecting pivot pin 57*a–d* which has a spherical head 58*a–d*. The spherical heads 58*a* and 58*d* are received in complementary cylindrical openings 59 formed in the connecting members 56 so as to afford the desired degree of pivotal movement in a direction indicated by the arrows 61 in FIG. 3. This pivotal movement will accommodate for manufacturing variations and permit free movement of the linkage and throttle valve shafts 42 without binding.

At least the throttle valve shaft 53*c*, the connection between the pivot pin 57*c* and the link 55 is provided by means of a pocket or socket 62 formed directly in the link and which receives an anti-friction bearing member 63 that has a ball and socket connection to the pivot pin head 58*d* as to also accommodate the pivotal movement as shown by the arrow 61. It is more desirable to afford more relative movement for the throttle valve levers 53 more removed from the manually operated throttle lever 51 so as to avoid the effect of tolerance stack-ups. Also, even though the thermal expansion has been accommodated for by this arrangement, the provision of greater degree or flexure of movement the more remotely the throttle lever 53 is from the manually operated throttle lever 51 is also desirable.

Figure 4:
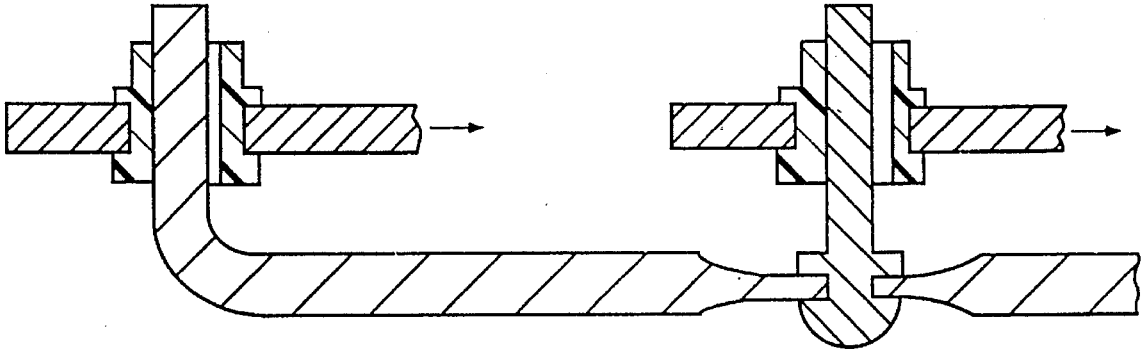
FIG. 4 is a cross-sectional view, in part similar to FIG. 3, and shows another embodiment of the invention.

FIG. 4 shows another embodiment of arrangement that will accommodate the thermal expansion and/or misalignments and this construction somewhat simpler than that previously described. In this embodiment, the interconnecting linkage indicated generally by the reference numeral 101 and includes a single link 102 it formed from a material having the same or substantially the same coefficient of thermal expansion as the cylinder head 13. This link 102 has at its opposite ends in-turned portions 103. The portion 103 adjacent the uppermost carburetor 38 is received within an enlarged bore 104 of an anti-friction insert piece 105 that is formed so as to be rigidly attached to the respective throttle lever 53. The bore 104 is larger than the diameter of the rod 103 so as to permit a limited degree of relative movement in the direction of the arrow 106 in this figure. A similar connection is provided at the opposite end to the manually operated throttle lever 51 but this connection need not provide the clearance so as to accommodate movement in the direction of the arrow 106 for the reasons aforenoted.

The connection between the intermediate throttle levers 53*b* and 53*c* and the link 102 is of the type shown in FIG. 4 to the right hand side and this also includes the connector 105 having the enlarged bore 104 that is affixed to the throttle lever 53. In this instance, however, a pin 107 has a upset headed portion 108 that provides a rigid connection to an opening 109 in the throttle link 102. This pin 107 has a shank 111 which is smaller in diameter than the bore 104 so as to provide the aforenoted clearance in the direction of the arrow 106. This clearance is, by the way, exaggerated in the figure so as to more clearly show the construction.

Figure 5:
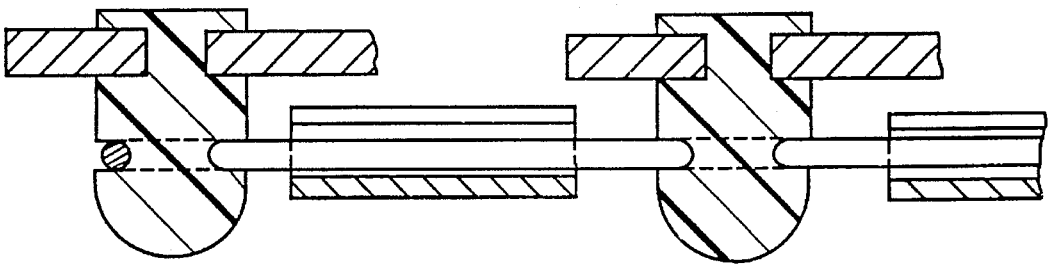
FIG. 5 is a cross-sectional view, in part similar to FIGS. 3 and 4 and shows another embodiment of the invention.
Figure 6:
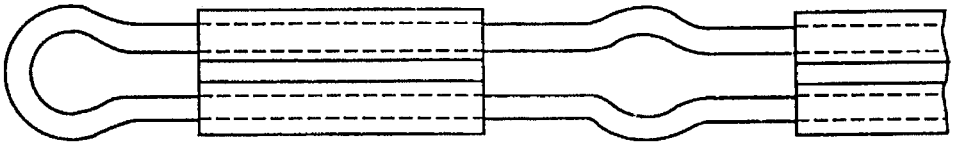
FIG. 6 is a view looking generally in the direction of the arrow 6 in FIG. 5 and shows the throttle link in accordance with this embodiment.

A connecting linkage constructed in accordance with another embodiment of the invention is depicted in FIGS. 5 and 6 and is indicated generally by the reference numeral 151. This connecting linkage 151 includes a rod shaped throttle link 152 that is bent so as to form a plurality of recesses 153*d* through a for providing the connection to the respective throttle levers 53*d,c,b*, and *a*. Like the previously described embodiments, the link 152 is formed from a material having a coefficient of thermal expansion the same or substantially the same as that of the engine cylinder head 13 and specifically the flange 32.

Slide-type lock fasteners 154 are received upon the link 152 and serve a purpose which will be described. Each throttle lever 53*a–d* is provided with an opening 155 that receives a pivot pin 156 which may be formed from an anti-friction material such as a plastic or the like. The respective pivot pins are formed with slots 157 into which the recesses 153 of the link 152 are received and the fasteners 154 are slid to a locking position. The fit between the slots 157 and recesses 153 are such that some axial movement in the direction of the arrow 106 in FIG. 4 will be permissible with this degree of axial movement being progressively larger at the connections furthest from the manually operated throttle lever 151 as previously noted.

Figure 7:
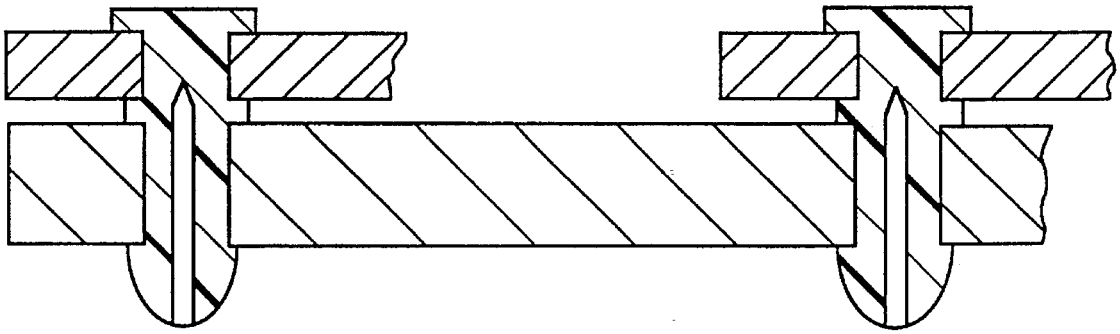
FIG. 7 is a cross-sectional view, in part similar to FIGS. 3, 4, and 5 and shows a still further embodiment of the invention.
Figure 8:
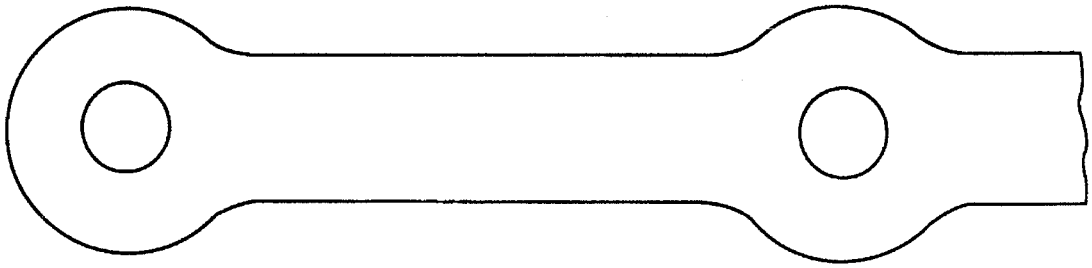
FIG. 8 is a side elevational view of the connecting throttle link in this embodiment.

Another embodiment of connecting linkage is shown in FIGS. 7 and 8 and is identified generally by the reference numeral 201. This connecting linkage performs the same functions as though previously described but is constructed in such a way so as to operate further simplification of the overall construction. In this embodiment a throttle link 202 is provided which is a generally planar member and which is formed from a material having substantially the same coefficient of thermal expansion as the cylinder head 13. This member 202 is formed with spaced openings 203 each of which receives a respective pin, indicated generally by the reference numeral 204 connected to the respective throttle lever 53. The pins 204 have portions 205 that are upset so as to form a rigid connection to the throttle lever 53. Headed portions 206 are slotted at 207 so as to be received in a snap fit in the link openings 203. The slots 207 further permit some relative axial movement so as to accommodate variations in alignment as previously described.

It should be readily apparent from the foregoing description that the described embodiments of the invention are extremely effective in providing a connection between a plurality of throttle bodies that are affixed to a member of the engine and which avoid the effects of differences in thermal expansion and also which accommodate manufacturing variations. Of course, the foregoing description is that of preferred embodiments of the invention and various changes and modifications may be made without departing from the spirit and scope of the invention, as defined by the appended claims.

We claim:

1. A throttle linkage system for an engine comprised of a plurality of throttle bodies all affixed to a common member for controlling the flow of a charge to an internal combustion engine, each throttle body having a rotatably journaled throttle valve shaft, an induction passage, a throttle valve within said induction passage and affixed to said throttle valve shaft, and a throttle lever affixed to said throttle valve shaft for operating said throttle valve shaft and the associated throttle valve, and a throttle link pivotally connected to said throttle levers, said link being formed from a material having substantially the same coefficient of thermal expansion as said common member.

2. A throttle linkage system for an engine as in claim 1, further including a manual operator operatively connected to one of the throttle levers for manual control of all of the throttle levers.

3. A throttle linkage system for an engine as in claim 2, wherein the connection between the throttle link and the non-manually operated throttle valve is such to accommodate relative movement due to misalignment.

4. A throttle linkage system for an engine as in claim 3, wherein the relative movement is pivotal movement.

5. A throttle linkage system for an engine as in claim 4, wherein the pivotal movement is accomplished by a ball-and-socket connection.

6. A throttle linkage system for an engine as in claim 3, wherein the relative movement is in a direction of movement of the throttle link and is accomplished by a pin-and-slot connection.

7. A throttle linkage system for an engine as in claim 6, wherein the pin-and-slot connection is provided by a pin formed on the throttle link and received in an elongated slot formed in the throttle lever.

8. A throttle linkage system for an engine as in claim 6, wherein the pin-and-slot connection is formed by a pin affixed to the respective throttle lever and having a groove, the throttle link being comprised of a formed wire member defining slots captured in the groove in the respective pin.

9. A throttle linkage system for an engine as in claim 6, wherein the pin-and-slot connection is provided by a pin affixed to one of the throttle lever and link and having a slotted head received in the other of the throttle lever and throttle link.

10. A throttle linkage system for an engine comprised of a plurality of throttle bodies all affixed to a common member for controlling the flow of a charge to an internal combustion engine, each throttle body having a rotatably journaled throttle valve shaft, an induction passage, a throttle valve within said induction passage and affixed to said throttle valve shaft, a throttle lever affixed to said throttle valve shaft for operating said throttle valve shaft and the associated throttle valve, a throttle link pivotally connected to said throttle valve levers, and means for providing a manual actuator for actuating the throttle lever at the end of a row of the throttle bodies, the connection between the throttle link and the throttle levers remotely positioned from the manually operated throttle lever comprising a pin and slot connection for affording relative movement to accommodate manufacturing variations.

11. A throttle linkage system for an engine as in claim 10, wherein the pin-and-slot connection is provided by a pin formed on the throttle link and received in an elongated slot formed in the throttle lever.

12. A throttle linkage system for an engine as in claim 10, wherein the pin-and-slot connection is formed by a pin affixed to the respective throttle lever and having a groove, the throttle link being comprised of a formed wire member defining slots captured in the groove in the respective pin.

13. A throttle linkage system for an engine as in claim 10, wherein the pin-and-slot connection is provided by a pin affixed to one of the throttle lever and link and having a slotted head received in the other of the throttle lever and throttle link.

* * * * *